US005624030A

United States Patent [19]

Rademacher

[11] Patent Number: 5,624,030

[45] Date of Patent: Apr. 29, 1997

[54] PACKAGING ASSEMBLY FOR PALLET TRANSPORT OF GOODS

[75] Inventor: Horst Rademacher, Ostercappeln, Germany

[73] Assignee: Felix Schoeller jr. Foto-und Spezialpapiere GmbH & Co. KG, Osnabruck, Germany

[21] Appl. No.: 402,121

[22] Filed: Mar. 10, 1995

[30] Foreign Application Priority Data

Mar. 11, 1994 [DE] Germany ..... 9404078 U

[51] Int. Cl.[6] ..... B65D 19/38

[52] U.S. Cl. ..... 206/386; 206/389

[58] Field of Search ..... 206/386, 600, 206/389, 391, 394

[56] References Cited

U.S. PATENT DOCUMENTS

| | | | |
|---|---|---|---|
| 1,148,948 | 8/1915 | Benjamin | 206/386 X |
| 3,949,929 | 4/1976 | Kupersmit | 206/600 X |
| 4,482,051 | 11/1984 | Cantey, Jr. | 206/386 X |
| 4,860,912 | 8/1989 | Kupersmit | 206/600 X |
| 5,244,108 | 9/1993 | Hale | 206/600 X |

FOREIGN PATENT DOCUMENTS

| | | |
|---|---|---|
| 2639911 | 6/1990 | France . |
| 2451052 | 5/1976 | Germany . |
| 2625461 | 12/1977 | Germany . |
| 8801345 | 5/1988 | Germany . |
| 4216895 | 11/1993 | Germany . |
| 4301509 | 7/1994 | Germany . |
| 1160908 | 8/1969 | United Kingdom . |
| 1191922 | 5/1970 | United Kingdom . |
| 1284270 | 8/1972 | United Kingdom . |

*Primary Examiner*—Jacob K. Ackun
*Attorney, Agent, or Firm*—Lockwood, Alex, Fitzgibbon & Cummings

[57] ABSTRACT

A packaging assembly for the pallet transport of goods consists of a pallet and a hood to cover the goods located on the pallet, in which the hood possesses a first opening located at its side which is capable of being repeatedly opened without destruction. The outer edge of a pallet plate of the pallet and the lower inner edge of the hood are designed so as to be lockable together.

13 Claims, 1 Drawing Sheet

PACKAGING ASSEMBLY FOR PALLET TRANSPORT OF GOODS

BACKGROUND OF THE INVENTION

The present invention relates generally to the packaging of goods for transport, and more particularly to a packaging assembly which covers the goods and a portion of the supporting pallet. Goods which are transported on pallets are typically either bulky goods or goods grouped together to form large units. These goods are normally fixed on the pallets by anchoring mechanism of various designs. In many cases, particularly with sensitive goods, protective packaging is necessary to protect the goods from loss of moisture, climatic influences or physical stresses.

One example of such protective packaging is the packaging of large rolls of photographic paper. Paper-based photographic support materials are currently mostly transported standing on end on pallets. As the final stage of the packaging, the photographic paper roll is wrapped in a shrink-wrap film type of covering. The entire packaging complex is structured in such a way that the paper rolls are protected from impact, water vapor and dust. Plastic film, and in particular shrink-wrap film, has proved successful and is used through the packaging industry for such packaging.

This type of packaging is not without problems. For example, when the goods are unpacked, the plastic film lands in the waste and has to be disposed of, for example, either by incineration or by depositing in a landfill. For reasons of environmental protection, and also for economic reasons, reusable packaging having a long life is desirable. The present invention proposes a solution to this problem by providing a packaging assembly for the pallet transport of goods, which includes a reusable packaging system having a long life, without having to accept any loss of protective qualities.

SUMMARY OF THE INVENTION

The present invention provides a packaging assembly including a pallet and a hood which covers the goods located on the pallet, the hood having a first opening located along its side which may be repeatedly opened and closed without destruction, and the hood further having another recloseable opening disposed along a lower inner edge of the hood which may be repeatedly engaged and disengaged with a portion of a supporting pallet.

The new packaging assembly of the invention facilitates rapid and trouble-free packaging, and is reusable to the extent that only destruction or major damage to the hood will lead to unusability of the assembly. Minor damage to the covering hood may be repaired relatively simply, for example, by pasting over cracks which form in the hood from use. Additionally, the form of the hood is easily adapted to configure to that of the goods to be packaged, with the result that any goods which have previously been transported on pallets and which require particular protective packaging can also be transported in this new packaging unit. Accordingly, the present invention may be utilized on the following goods: electrical appliances such as refrigerators, ovens, washing machines or the like, articles of furniture such as chairs, cupboards, tables or the like sheet and paper goods and web material which are wound up into rolls.

Textile fabric, non-woven and plastic films of both the coated and uncoated variety may be effectively used as the hood material and the hood may be coated with a coating material. In some instances, it is preferable to coat the hood material with a polyolefin, polyvinyl compound, polyester, polyamide, latex or its co-polymers in order to provide a sufficient degree of moisture impermeability to the hood.

In order to provide the openings of the hood with a recloseable nature, the covering hood may include a recloseable fastener assembly utilizing, for example hook and loop fasteners such as those formed from Velcro® which has proven a particularly well-suited catch system, as it is long-lived and facilitates rapid opening and closing. Zip fasteners, press studs, adhesive strips and tapes are also fundamentally suitable. A rubber band may be also suitable for the connection of the pallet plate and hood.

The pallet portion of the assembly may consist of wood or plastic, and also of a combination of both materials. Metal pallets are also suitable, although they are not as frequently encountered as the above-cited materials. The shape of the pallet is preferably to be designed with projections which surround the supported goods in such a way that the hood is not subject to any impact stresses when the pallets are placed together.

A packaging assembly having a cylindrical style hood and circular pallet is particularly preferred. It is used for packaging of web material wound up into rolls, such as photographic medium material.

Accordingly, it is an object of the present invention to provide an improved packaging assembly for palletized goods.

It is another object of the present invention to provide a packaging assembly for palletized goods which includes a covering hood which overlies a unit of goods and a pallet configured to support the unit of goods and to engage the covering hood such that the covering hood and pallet cooperate to substantially enclose the unit of goods on the pallet.

A further object of the present invention is to provide a packaging assembly having a reusable covering hood which defines a flexible enclosure which receives a unit goods therein, the covering hood having a first rechargeable opening which permits the covering hood to be applied over the unit of goods and a second recloseable opening which permits the covering hood to be attached to a support pallet, each of the two openings including recloseable fastener means, the assembly further including a cushion member interposed between the pallet and the unit of goods to provide a moisture impermeable barrier between the two which seals off the bottom of the covering hood.

These and other objects, features and advantages of the present invention will be apparent through a reading of the following detailed description, taken in conjunction with accompanying drawings, wherein like reference numerals refer to like parts.

BRIEF DESCRIPTION OF DRAWINGS

In the course of the description, reference will be made to the attached drawings in which.

Detailed Description of the Preferred Embodiments

Figure 1:
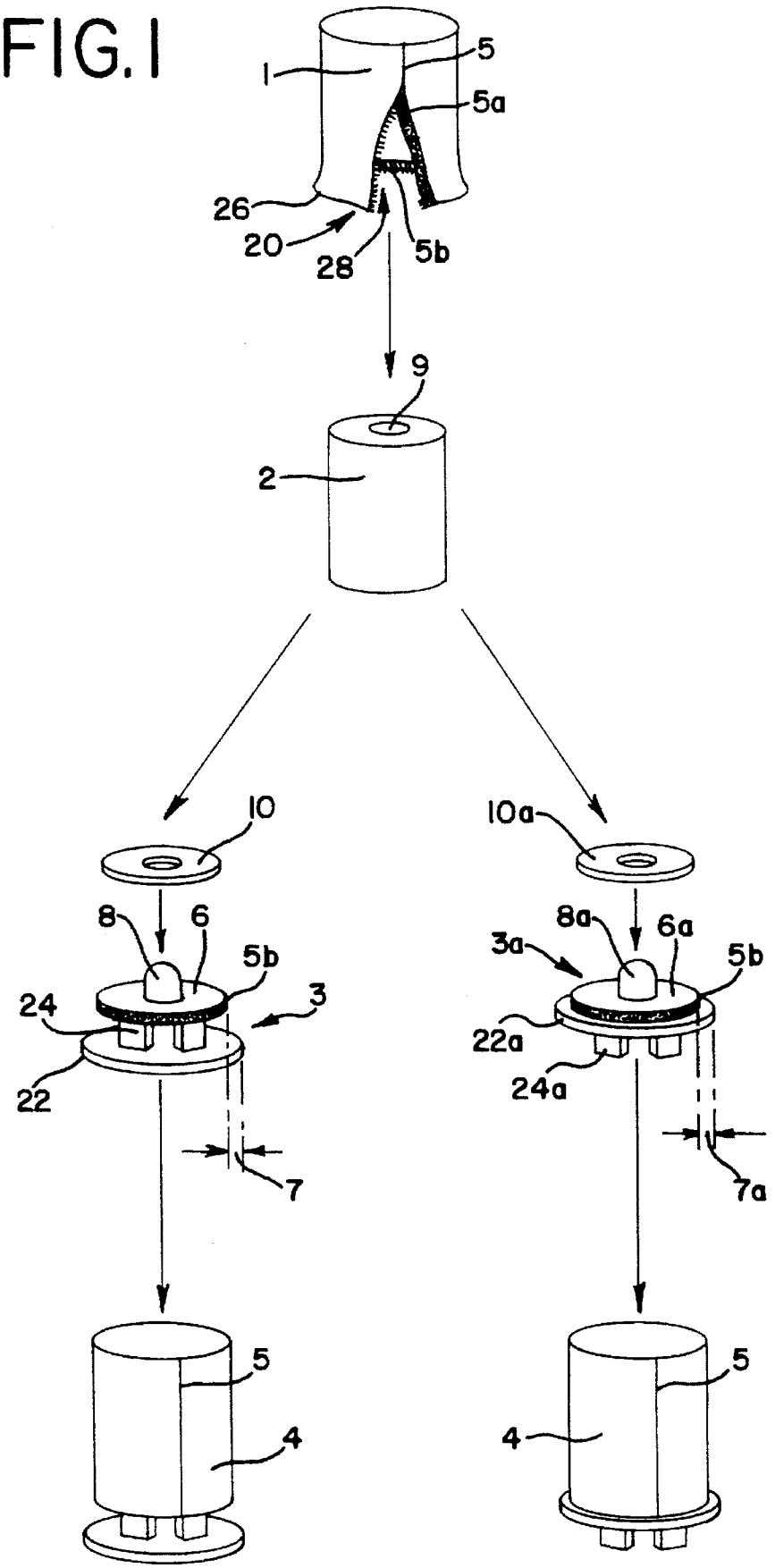
FIG. 1 is an exploded perspective view of a packaging assembly in accordance with the principles of the present invention.

FIG. 1 illustrates, in an iterative assembly fashion, a packaging assembly constructed in accordance with the principles of the present invention. A package member, illustrated as a covering hood 1, is provided for a roll 2 of paper, particularly photographic paper. The covering hood 1 includes a hollow cavity 20 defined by the interior surfaces of the covering hood 1. The package member 1 further includes an opening, or seam 5, which extends for the length of the covering hood 1 as illustrated.

The seam 5 may be provided with a resealable closure means, illustrated as strips of hook and loop fasteners 5*a*, applied to opposing edges of the seam. Suitable hook and loop fasteners are commonly available in such strips under the trade name Velcro®. The covering hood 1 may preferably be formed from a woven fabric or a non-woven or a plastic film. These materials may be used in the natural state, or they may be coated with a coating of polyolefin, polyvinyl compound, polyester, polyamide, latex or its co-polymers.

The packaging assembly of the present invention also includes a support member, illustrated as circular pallets 3, 3*a*. The pallets 3, 3*a* are illustrative of two different embodiments. The first pallet 3 has a circular base portion 22 having a flat bottom surface and a series of support legs 24 which extend upwardly therefrom to support a circular pallet plate 6. The pallet plate 6 preferably has a diameter which is less than the diameter of the base portion 22 so as to define an annular projecting portion, or rim 7, of the pallet 3 with respect to the unit of goods mounted thereupon and enclosed within the covering hood 1. This projection 7 serves to set off the goods from the edge of the pallet 3 and provide some measure of protection from other packaging assemblies stored nearby.

The pallet 3 further preferably includes a means to engage the paper roll 2, illustrated as a journal 8, which may be rotatably held within the pallet plate 6 and which is received within the inner core 9 of the paper roll 2 to engage the roll and retain it on the pallet 3. The pallet 3 may be formed from wood, plastic or a composite material. The pallet 3 may further include a circular cushion plate 10, sized for engagement on the pallet plate 6 over the journal 8 as illustrated, which cushions the lower end of the paper roll 2 and which also provides a moisture barrier for the goods.

The cushion plate 10 is interposed, as illustrated, between the pallet plate 6 and the bottom surface of the unit of goods 2 and extends to the outer perimeter of the unit of goods where it may abut the interior perimeter of the covering hood 2. Inasmuch as the cushion plate 10 is positioned above the point of engagement between the covering hood 2 and the pallet plate 6, as explained below, it will provide a seal to the bottom of the covering hood.

In order to keep the moisture content of the goods 2 supported on the pallet 3 constant, the hood and pallet are preferably designed to be impermeable to water vapor and other forms of moisture. An 85 $g/m^2$ heavy polyester fabric, coated with 195 $g/m^2$ polyvinyl chloride has proven particularly suitable for the covering hood, while polyurethane has proven suitable for the cushion plate 10 of the pallet 3.

Similarly, the alternate embodiment of the pallet 3*a* illustrated to the right in FIG. 1, includes a circular base portion 22*a* supported on a series of support legs 24*a*. A pallet plate 6a which has a diameter approximately equal to the paper roll 2 and less than the pallet base portion 22*a* is also provided and receives a paper roll journal 8*a* and cushion plate 10*a* thereon.

In an important aspect of the present invention the covering hood 1 also includes a second opening 28 formed along the bottom interior perimeter 26 of the covering hood 1. This opening 28 preferably includes a recloseable fastener means which is intended to engage a portion of the pallet plate 6. This recloseable fastener means is illustrated as a pair of hook and loop fastener strips 5*b*. One of the strips is applied or otherwise formed on the covering hood opening perimeter, while the other strip is applied to the exterior perimeter of the pallet plates 6, 6*a* in order to provide a closure surface between the pallet 3, 3*a* and the package member 1. Other closure materials such as zip fasteners, press studs, adhesive strips and tapes and elastic bands may be also be used. The final packaging assembly, in a completed state, is illustrated at 4 in FIG. 1.

Although in the description set forth above, the pallets 3, 3*a* have been described as generally circular in configuration, it will be understood that other pallet configurations, such as rectangular or square are also suitable. It will also be appreciated that although the above description describes the invention in terms of a single good, i.e. a single roll of photographic paper, the invention is equally applicable to units of goods which constitute multiple containers of goods, i.e. an array of cartons, components or the like. Regardless of the pallet configuration, it is preferred that the pallet have an outer diameter or perimeter which is larger than that of the unit of goods mounted thereupon to provide a projecting border which surrounds the goods. Similarly, it will be recognized that the present invention is applicable to other types of goods, such as appliances, articles of furniture, paper stocks or other webbed material.

Accordingly, it will be appreciated that the embodiments of the present invention have discussed herein are merely illustrative of a few applications of the principles of the invention. Numerous modifications may be made by those skilled in the art without departing from the true spirit and scope of the invention.

I claim:

1. A package assembly for the pallet transport of goods, comprising: a pallet member for supporting a unit of goods thereon, the pallet member having a support portion for supporting said pallet member on a surface and a plate portion for supporting said unit of goods upon said pallet member, said plate portion being separate from said support portion and having a perimeter less than the perimeter of said support portion, the assembly further including a package hood for covering said unit of goods on said pallet member by enclosing said unit of goods, the package hood having a first opening extending generally lengthwise which permits said package hood to be applied to the unit of goods and a second opening at an end of said package hood which engages said pallet member to substantially enclose the unit of goods when the unit of goods is positioned upon said pallet member, said package hood including a first recloseable means disposed along said first opening and a second recloseable means at said package hood second opening which includes one recloseable fastener strip disposed at said package hood second opening and a second recloseable fastener strip disposed on said pallet member on an edge of said plate portion and extending around the perimeter thereof and in opposition to said packaging hood one recloseable fastener strip, whereby said package hood and said pallet member may be interconnected together beneath a bottom surface of the unit of goods, and a barrier member interposed between the unit of goods and said pallet member plate portion which defines a seal at said package hood second opening between the unit of goods and said pallet member when the unit of goods is positioned on the pallet member.

2. The packaging assembly as defined in claim 1, including in combination therewith the unit of goods, and wherein said unit of goods constitutes a single good.

3. The package assembly as defined in claim 1, including in combination therewith said unit of goods, and wherein said plate portion has a perimeter which approximates a perimeter of said unit of goods.

4. The packaging assembly as defined in claim 1, wherein said package hood adjacent the pallet member and the pallet member are generally circular.

5. The packaging assembly as defined in claim 1, wherein said package hood is generally cylindrical and said pallet member is generally circular.

6. The packaging assembly as defined in claim 1, wherein said recloseable means include hook and loop fasteners.

7. A packaging assembly as defined in claim 1, wherein said package hood is formed from a water-impermeable material.

8. A packaging assembly as defined in claim 4, wherein said package hood is formed from a moisture-impermeable material.

9. A packaging assembly as defined in claim 1, wherein said package hood is coated with a moisture-impermeable material selected from the group consisting essentially of polyolefin, polyvinyl chloride, polyester, polyamide, latex or its co-polymers.

10. The packaging assembly as defined in claim 1, wherein said package hood is formed from a polyester fabric with a polyvinyl chloride coating.

11. The packaging assembly as defined in claim 4, wherein said pallet member is formed from wood and said barrier member includes a cushioning member interposed between said pallet member and said unit of goods, the cushioning member being formed from a moisture-impermeable material and providing a moisture impermeable seal between said pallet member and said package hood.

12. The packaging assembly as defined in claim 11, wherein said cushioning plate is formed from a polyurethane.

13. The packaging assembly as defined in claim 1, wherein said barrier member includes cushioning member which is formed from a moisture impermeable material.

* * * * *

UNITED STATES PATENT AND TRADEMARK OFFICE

CERTIFICATE OF CORRECTION

PATENT NO. : 5,624,030

DATED : April 29, 1997

INVENTOR(S) : Horst Rademacher

It is certified that error appears in the above-indentified patent and that said Letters Patent is hereby corrected as shown below:

Col. 1, line 62, after "like" insert a comma --,--.
Col. 2, line 40, delete "rechargeable"; line 42, delete "recloseable"; line 62, delete the title "Detailed Description of the Preferred Embodiments" and insert the title --DETAILED DESCRIPTION OF THE PREFERRED EMBODIMENTS--.
Col. 4, line 8, delete "be" (first occurrence).
Col. 6, line 15, delete "plate" and insert --member--.

Signed and Sealed this

Eleventh Day of November, 1997

*Attest:*

*Attesting Officer*

Bruce Lehman

BRUCE LEHMAN

*Commissioner of Patents and Trademarks*